US010798807B2

(12) United States Patent
Sakamoto et al.

(10) Patent No.: US 10,798,807 B2
(45) Date of Patent: Oct. 6, 2020

(54) STRUCTURE OF REMOVING STATIC ELECTRICITY IN LOW-HUMIDITY SPACE

(71) Applicants: NIHON SPINDLE MANUFACTURING CO., LTD., Hyogo (JP); NATIONAL INSTITUTE OF ADVANCED INDUSTRIAL SCIENCE AND TECHNOLOGY, Tokyo (JP)

(72) Inventors: Taichi Sakamoto, Osaka (JP); Takashi Mukai, Osaka (JP); Yuta Ikeuchi, Osaka (JP); Masahiro Yanagida, Osaka (JP); Kenji Izumi, Hyogo (JP); Teppei Taniguchi, Hyogo (JP)

(73) Assignees: NIHON SPINDLE MANUFACTURING CO., LTD., Hyogo (JP); NATIONAL INSTITUTE OF ADVANCED INDUSTRIAL SCIENCE AND TECHNOLOGY, Tokyo (JP)

( * ) Notice: Subject to any disclaimer, the term of this patent is extended or adjusted under 35 U.S.C. 154(b) by 67 days.

(21) Appl. No.: 15/935,991

(22) Filed: Mar. 26, 2018

(65) Prior Publication Data

US 2018/0213631 A1 Jul. 26, 2018

Related U.S. Application Data

(63) Continuation of application No. PCT/JP2017/002631, filed on Jan. 26, 2017.

(30) Foreign Application Priority Data

Feb. 8, 2016 (JP) ..... 2016-021861

(51) Int. Cl.
*H05F 3/06* (2006.01)
*F24F 3/14* (2006.01)
(Continued)

(52) U.S. Cl.
CPC ..... *H05F 3/06* (2013.01); *F24F 3/14* (2013.01); *H05F 3/04* (2013.01); *F24F 3/161* (2013.01);
(Continued)

(58) Field of Classification Search
CPC ..... H05F 3/06; F24F 3/14; H01T 23/00
See application file for complete search history.

(56) References Cited

U.S. PATENT DOCUMENTS 4,484,249 A * 11/1984 Saurenman ..... H05F 3/04 361/212
4,542,434 A * 9/1985 Gehlke ..... H05F 3/04 361/213
(Continued)

FOREIGN PATENT DOCUMENTS

EP 2 036 856 A2 3/2009
JP H04-150962 A 5/1992
(Continued)

OTHER PUBLICATIONS

Search report issued in European Application No. 17750081.6, dated Jul. 18, 2019.
(Continued)

*Primary Examiner* — Scott Bauer
(74) *Attorney, Agent, or Firm* — Michael Best & Friedrich LLP

(57) ABSTRACT

There is provided a static electricity removal structure in a low-humidity space, in which static electricity can be removed with high efficiency in the low-humidity space by using a static electricity removal device. A low-humidity space is configured such that dehumidified air is supplied from one side of the low-humidity space into the low-humidity space through a blowout surface material in which ventilation pore is formed, and exhausting is performed
(Continued)

from the other side of the low-humidity space, which opposes the blowout surface material. A static electricity removal device is disposed on a downstream side of the blowout surface material.

21 Claims, 4 Drawing Sheets

(51) Int. Cl.

| | |
|---|---|
| ***H05F 3/04*** | (2006.01) |
| *F24F 7/06* | (2006.01) |
| *F24F 3/16* | (2006.01) |
| *H01H 19/00* | (2006.01) |
| *H01H 23/00* | (2006.01) |

(52) U.S. Cl.
CPC ..... *F24F 7/06* (2013.01); *F24F 2003/144* (2013.01); *H01H 19/00* (2013.01); *H01H 23/00* (2013.01)

(56) References Cited

U.S. PATENT DOCUMENTS

| | | | | |
|---|---|---|---|---|
| 4,689,715 | A | 8/1987 | Halleck | |
| 4,864,459 | A * | 9/1989 | Larigaldie | B08B 9/00 361/216 |
| 6,126,722 | A * | 10/2000 | Mitchell | B03C 3/09 361/226 |
| 7,156,897 | B2 * | 1/2007 | Wen | A23L 3/28 422/121 |
| 7,976,599 | B2 | 7/2011 | Sakai et al. | |
| 8,372,372 | B2 | 2/2013 | Sakai et al. | |
| 8,450,698 | B2 * | 5/2013 | Hung | H01T 19/04 250/324 |
| 2003/0196888 | A1 | 10/2003 | Chang | |
| 2016/0249441 | A1 * | 8/2016 | Hariya | H01T 23/00 |

FOREIGN PATENT DOCUMENTS

| | | | |
|---|---|---|---|
| JP | H05-021131 | A | 1/1993 |
| JP | H10-311556 | A | 11/1998 |
| JP | H11-083104 | A | 3/1999 |
| JP | 2008-275233 | A | 11/2008 |
| JP | 2009-078961 | A | 4/2009 |
| JP | 2009-198015 | A | 9/2009 |
| JP | 2011-238392 | A | 11/2011 |
| JP | 2014-169815 | A | 9/2014 |
| JP | 2014-169816 | A | 9/2014 |

OTHER PUBLICATIONS

International Search Report issued in Application No. PCT/JP2017/002631, dated Apr. 25, 2017.

* cited by examiner

| BLOWING TYPE | DISTANCE X (mm) | POSITION | DISCHARGE TIME (s) | AVERAGE TIME (s) |
|---|---|---|---|---|
| TURBULENCE | 950 (FL+1500) | 1 | 119.5 | 82.34 |
| | | 2 | 59.3 | |
| | | 3 | 64.7 | |
| | | 4 | 52.3 | |
| | | 5 | 115.9 | |
| LAMINAR FLOW | | 1 | 50.9 | 51.06 |
| | | 2 | 35 | |
| | | 3 | 50.3 | |
| | | 4 | 53.3 | |
| | | 5 | 65.8 | |

* -5000V, LOWER LIMIT -500V, DEW POINT TEMPERATURE ABOUT -60°C

STRUCTURE OF REMOVING STATIC ELECTRICITY IN LOW-HUMIDITY SPACE

RELATED APPLICATIONS

Priority is claimed to Japanese Patent Application No. 2016-021861, filed Feb. 8, 2016, and International Patent Application No. PCT/JP2017/002631, the entire content of each of which is incorporated herein by reference.

BACKGROUND

Technical Field

Certain embodiment of the present invention relates to a static electricity removal structure, for example, a space in which only the atmosphere of a limited necessary place in which various works such as assembling of electronic components, manufacturing of a secondary battery (including components), and examinations thereof are performed is held to be in a predetermined low-humidity state (referred to as "a low-humidity space" in this specification).

Description of Related Art

In the related art, in order to hold only the atmosphere of a limited necessary place in which various works such as assembling of electronic components, manufacturing of a secondary battery (including components), and examinations thereof are performed to be in a predetermined state, a booth in which a booth space is partitioned from an external space with a synthetic resin sheet is widely used.

Further, in order to improve air-tightness and the heat insulation property of the booth space, a case of a double structure of sheets has also been proposed (for example, see the related art).

SUMMARY

According to an embodiment of the present invention, there is provided a static electricity removal structure in a low-humidity space being a static electricity removal structure in a low-humidity space, to which dehumidified air is supplied. The low-humidity space is configured such that dehumidified air is supplied from one side of the low-humidity space into the low-humidity space in a laminar flow state through a blow port and exhausting is performed from the other side of the low-humidity space, which opposes the blow port. A static electricity removal device is disposed on a downstream side of the blow port.

In this case, a dew point temperature of the dehumidified air supplied through the blow port maybe set to −30° C. or lower.

In this case, a blowout surface material in which a ventilation pore is formed may be provided in the blow port.

The blowout surface material in which the ventilation pore is formed may be formed with a synthetic resin member.

A pair of static electricity removal devices may be arranged, and one of the static electricity removal devices may alternately generate positive ions and negative ions at a timing different from a timing when the other alternately generates positive ions and negative ions.

The static electricity removal device maybe disposed to be spaced from the blow port.

The low-humidity space may be covered with a double structure curtain, and exhausting may be forcibly performed from a space formed by the double structure curtain.

According to the static electricity removal structure in a low-humidity space according to the embodiment of the invention, the low-humidity space is configured such that dehumidified air is supplied from one side of the low-humidity space into the low-humidity space in a laminar flow state through a blow port and exhausting is performed from the other side of the low-humidity space, which opposes the blow port. In addition, a static electricity removal device is disposed on a downstream side of the blow port. Thus, even in a low-humidity space in which the moisture content in air is very small, in particular, even in an ultra-low humidity space in which the dew point temperature is −30° C. or lower, it is possible to supply ionized air so as to be dispersed in the entirety of the low-humidity space and to remove static electricity with high efficiency by using the static electricity removal device, while generation of static electricity by an air flow and elimination of ions by collision between positive ions and negative ions are prevented.

Since the blowout surface material in which the ventilation pore is formed is provided in the blow port, it is possible to supply the dehumidified air into the low-humidity space, in a laminar flow state by a simple structure.

Since the blowout surface material in which the ventilation pore is formed is formed of the synthetic resin member, the positive ions and the negative ions included in the ionized air are attracted by the blowout surface material. Thus, it is possible to prevent an occurrence of a situation in which an effect of removing static electricity is not obtained.

Since a pair of static electricity removal devices is arranged and one static electricity removal device alternately generates positive ions and negative ions at a timing different from a timing at which the other static electricity removal device alternately generates positive ions and negative ions, it is possible to reliably supply the ionized air so as to be dispersed in the entirety of the low-humidity space while elimination of ions by collision between the positive ions and the negative ions are prevented.

Since the static electricity removal device is disposed to be spaced from the blow port, it is possible to prevent an occurrence of a situation in which ions are eliminated by positive ions and negative ions included in the ionized air colliding with the blow port and the effect of removing static electricity is not obtained.

Since the low-humidity space is covered by the double structure curtain and exhausting is forcibly performed from a space formed by the double structure curtain, it is possible to reduce the amount of dehumidified air supplied into the low-humidity space without being influenced by the atmosphere of an external space or incoming or outgoing of people. In addition, it is possible to reduce energy cost and prevent the generation of static electricity by an air flow.

BRIEF DESCRIPTION OF THE DRAWINGS

FIG. 1A is a front sectional view and FIG. 1B is a sectional view taken along X-X.

FIG. 2A is a plan view and FIG. 2B is a front sectional view.

DETAILED DESCRIPTION

Figure 1A:
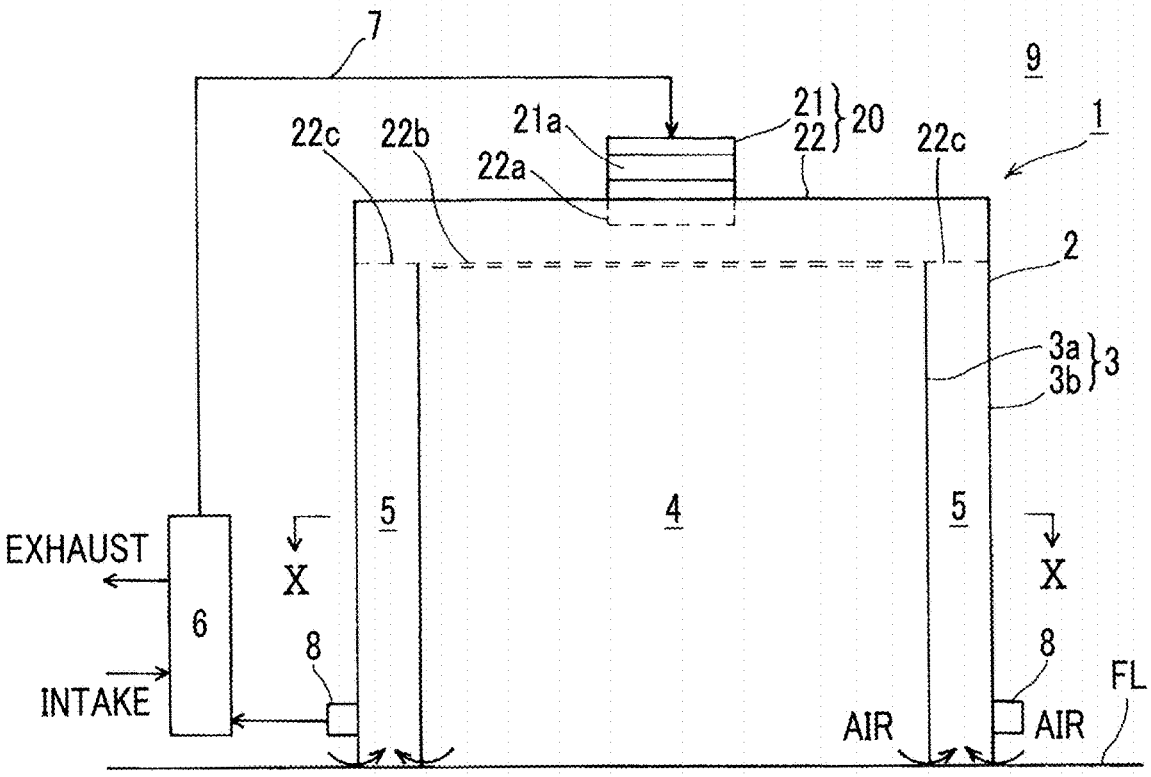
FIGS. 1A and 1B illustrate an example of a dry booth to which a static electricity removal structure in a low-humidity space according to an embodiment of the invention is applied.

Recently, demands for holding only the atmosphere of a limited necessary place to be in a predetermined low-humidity state in a case where various works such as assembling of electronic components, manufacturing of a secondary battery (including components), and examinations thereof are performed have grown.

Since the works require no static electricity in many cases, demands for removing static electricity have also grown.

Generally, a static electricity removal device (also referred to as "an ionizer" and simply referred to as "a static electricity removal device" in this specification) is used for removing static electricity in a space in which various works are performed. The static electricity removal device causes corona discharge by concentrating an electric field on a needle-like discharge electrode and removes static electricity with ionized air.

However, "reduction in humidity" and "removal of static electricity" has a trade-off relationship. Thus, there is a problem as follows in a low-humidity space. That is, even though the static electricity removal device is applied to a low-humidity space (in this specification, referring to a space in which a dew point temperature is 0° C. or lower), it is difficult to remove static electricity by ionized air with high efficiency because the moisture content in an air is low in a low-humidity space.

In particular, in facilities for forming a low-humidity space (booth space) in the related art, in order to maintain low humidity, a large amount of dehumidified air is supplied to the space at a high wind speed. Thus, the air is supplied in a turbulent state, and there is a problem in that positive ions collide with negative ions, ions are eliminated, and thus an effect of removing static electricity is not obtained even though the static electricity removal device is applied.

Therefore, it is difficult to establish both "the reduction in humidity" and "the removal of static electricity".

Considering the above-described problems in the related art, an object of embodiment of the invention is to provide a static electricity removal structure in a low-humidity space, in which static electricity can be removed with high efficiency in the low-humidity space by using a static electricity removal device.

Hereinafter, an embodiment of a static electricity removal structure in a low-humidity space according to the invention will be described with reference to the drawings.

The static electricity removal structure in the low-humidity space according to the embodiment of the invention is a static electricity removal structure in a low-humidity space, to which dehumidified air is supplied. The low-humidity space is configured such that dehumidified air is supplied from one side of the low-humidity space into the low-humidity space in a laminar flow state through a blow port and exhausting is performed from the other side of the low-humidity space, which opposes the blow port. A static electricity removal device is disposed on a downstream side of the blow port.

Figure 1B:
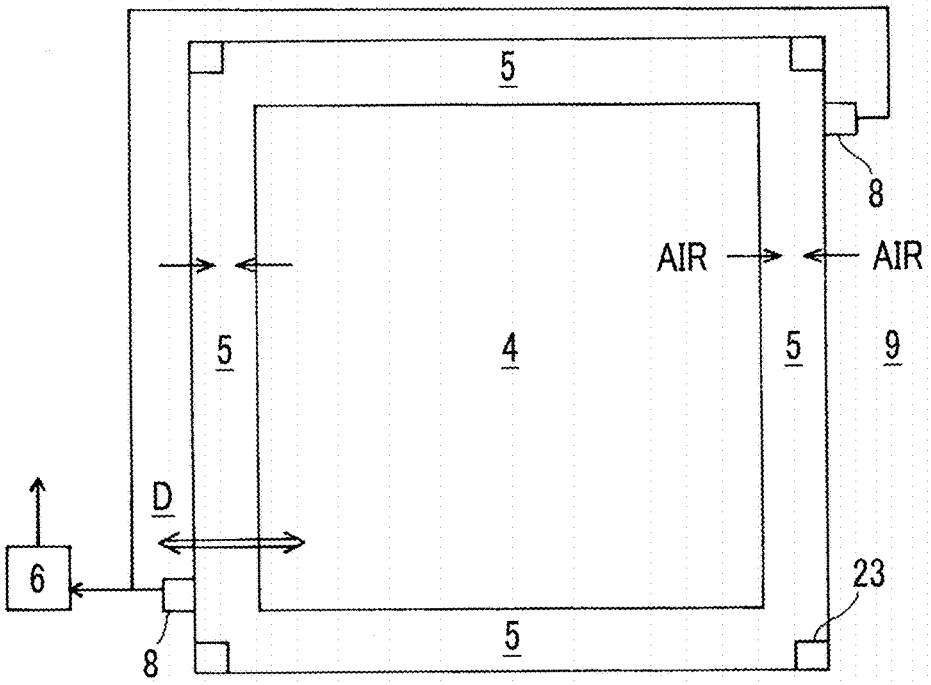

FIGS. 1A and 1B illustrate an example of a dry booth to which the static electricity removal structure in the low-humidity space according to the embodiment of the invention is applied, that is, which is used for forming a low-humidity space.

In a dry booth 1, a curtain 3 constituting a circumferential wall of a booth main body 2 has a double structure of an inner curtain 3*a* and an outer curtain 3*b*. Exhausting is forcibly performed from a space 5 formed between the double structure curtains 3*a* and 3*b*. The exhausted air is supplied to a booth space (low-humidity space) 4 partitioned by the inner curtain 3*a* and the space 5 formed between the double structure curtains 3*a* and 3*b* through a dehumidification unit 6 such that the space 5 formed between the double structure curtains 3*a* and 3*b* is held at negative pressure with respect to at least the booth space 4 (further, the external space 9 in some cases).

The booth main body 2 includes a chamber 20 disposed on the top of the booth main body 2 and four posts 23 standing on the bottom surface FL. The booth main body 2 is configured to cause four corners of the chamber 20 to be joined to the upper end portions of the four posts 23.

The chamber 20 is obtained by combining an upstream chamber 21 and a downstream chamber 22 disposed on the downstream side thereof. The upstream chamber 21 is connected from the dehumidification unit 6 through a duct 7.

If necessary, the upstream chamber 21 includes an air filter unit 21*a*. Thus, an air sent from the dehumidification unit 6 through the duct 7 is purified in the upstream chamber, and the purified air is supplied to the downstream chamber 22.

The downstream chamber 22 constitutes a blow port of dehumidified air. Thus, the downstream chamber includes a diffusion plate 22*a*, a blowout surface material 22*b* such as a screen mesh, a punching material, and a sheet in which pores are formed, and a blowout surface material 22*c*. In the blowout surface material, a ventilation pore is formed. In the blowout surface material 22*c*, a ventilation hole is formed. The downstream chamber causes a dried air sent from the dehumidification unit 6 to be uniformly supplied to the booth space 4 partitioned by the inner curtain 3*a* and the space 5 formed between the double structure curtains 3*a* and 3*b*.

Thus, the dehumidified air which has passed through the downstream chamber 22 is supplied in a laminar flow state, to the booth space 4.

Here, the structure of the downstream chamber 22 is not particularly limited so long as the dehumidified air can be supplied in the laminar flow state, to the booth space 4.

The blowout surface material 22*c* in which the ventilation hole is formed is not necessarily provided. The blowout surface material 22*c* can be omitted and the blowout surface material 22*b* can directly face the booth space 4.

Synthetic resin members of polyester resin, polyolefin resin, vinyl chloride resin, and the like are preferably used for the blowout surface material 22*b* in which the ventilation pore is formed and the blowout surface material 22*c* in which the ventilation hole is formed.

Thus, positive ions and negative ions included in the ionized air are attracted by the blowout surface materials 22*b* and 22*c*, and thus it is possible to prevent an occurrence of a situation in which the effect of removing static electricity is not obtained.

The ratio of the air supplied to both spaces 4 and 5 can be randomly adjusted by adjusting an opening area of the ventilation pore or the ventilation hole formed in the blowout surface material 22*b* or the blowout surface material 22*c* with a closing plate (not illustrated).

The type of the dehumidification unit 6 is not particularly limited so long as the dehumidification unit can introduce the air which has been forcibly exhausted from the space 5 formed between the double structure curtains 3*a* and 3*b*, from an outlet portion 8 disposed in the outer curtain 3*b* and discharge the dried air. The well-known dehumidification unit in the related art can be used as the dehumidification unit 6.

If necessary, a temperature control unit can be provided in the dehumidification unit 6, or a unit having a dehumidification function and a temperature control function can be used.

In the example, the outlet portion 8 is disposed at a position of a lower portion of the outer curtain 3*b* which is diagonal to the position of the booth main body 2, in order to exhaust the air in the space 5 formed between the double structure curtains 3*a* and 3*b*.

As described above, exhausting is performed from a plurality of places at a lower portion of the space 5 formed between the double structure curtains 3*a* and 3*b*. Thus, it is possible to reduce bias of air pressure of the space 5 formed between the curtains 3*a* and 3*b*. In addition, it is possible to reliably prevent inflow of an air of the external space 9 into the booth space 4 and to stably hold the atmosphere of the booth space 4 to be in a predetermined state.

The position of the outlet portion 8 or the number of outlet portions can be randomly set.

The curtains 3*a* and 3*b* are set to have a length as long as the upper ends of the curtains 3*a* and 3*b* are connected to the upstream chamber 21 and the lower ends thereof almost come into contact with the bottom surface FL. Thus, the air-tightness between the booth space 4 partitioned by the inner curtain 3*a* and the space 5 formed between the double structure curtains 3*a* and 3*b* is held to a certain extent, in comparison to that between the space 5 formed between the double structure curtains 3*a* and 3*b* and the external space 9.

A gap between the inner curtain 3*a* and the outer curtain 3*b* can be randomly set in a range of a several cm to tens cm. However, it is preferable that the distance of a place in which a person goes in and out is set to a dimension in which a person who comes in and goes out stays in the space 5 formed between the double structure curtains 3*a* and 3*b*, specifically, is set to be 50 cm or greater.

Thus, when a person comes in or goes out, the inner curtain 3*a* and the outer curtain 3*b* may not open simultaneously and the inner curtain 3*a* can be opened in a state where the atmosphere of the space 5 formed between the double structure curtains 3*a* and 3*b* is stable. Accordingly, it is possible to significantly exclude an influence of a person incoming and outgoing.

The curtains 3*a* and 3*b* can be formed with a sheet formed of synthetic resin such as polyolefin resin, vinyl chloride resin, and polyester resin or the like or can be formed of any material having no air permeability, such as a cloth on which a synthetic resin film is laminated.

The air pressure of the booth space 4 is slightly higher than the air pressure (generally, atmospheric pressure) of the external space 9. Specifically, the air pressure thereof is preferably higher than the air pressure of the external space 9 by substantially several Pa. More specifically, the air pressure of the booth space is preferably held at positive pressure of about +2 to +3 Pa.

Therefore, regarding the air pressure condition of each of the spaces, a device constituting a circulation path of an air, which includes the dehumidification unit 6 is operated so as to satisfy the condition of ((air pressure of space 5 formed between the double structure curtains 3*a* and 3*b*)<(air pressure of external space 9)<(air pressure of booth space 4)) (or ((air pressure of external space 9)<(air pressure of space 5)<(air pressure of booth space 4)).

Thus, the air flows into the space 5 formed between the double structure curtains 3*a* and 3*b*, from the booth space 4 and the external space 9 through the gap between lower ends of the curtains 3*a* and 3*b* and the bottom surface FL.

According to the dry booth 1, the space 5 formed between the double structure curtains 3*a* and 3*b* is held to have negative pressure with respect to the booth space 4 and the external space 9. Thus, in comparison to a case where the booth space 4 is simply held at positive pressure or negative pressure, an influence of the atmosphere of the external space 9 or a person incoming and outgoing is less applied. It is possible to reduce the air volume of an air which is air-conditioned and is supplied to the booth space 4, for example, in order to hold the dew point temperature of the air in the booth space 4 to be low, and to reduce energy cost. In addition, it is possible to suppress an occurrence of a situation in which the material in the booth space 4 flows out to the external space 9 by the air, by interposing the space 5 which is held at negative pressure with respect to the booth space 4 and the external space 9 and is formed between the double structure curtains 3*a* and 3*b*. It is possible to use a booth with safety and low cost.

Figure 2B:
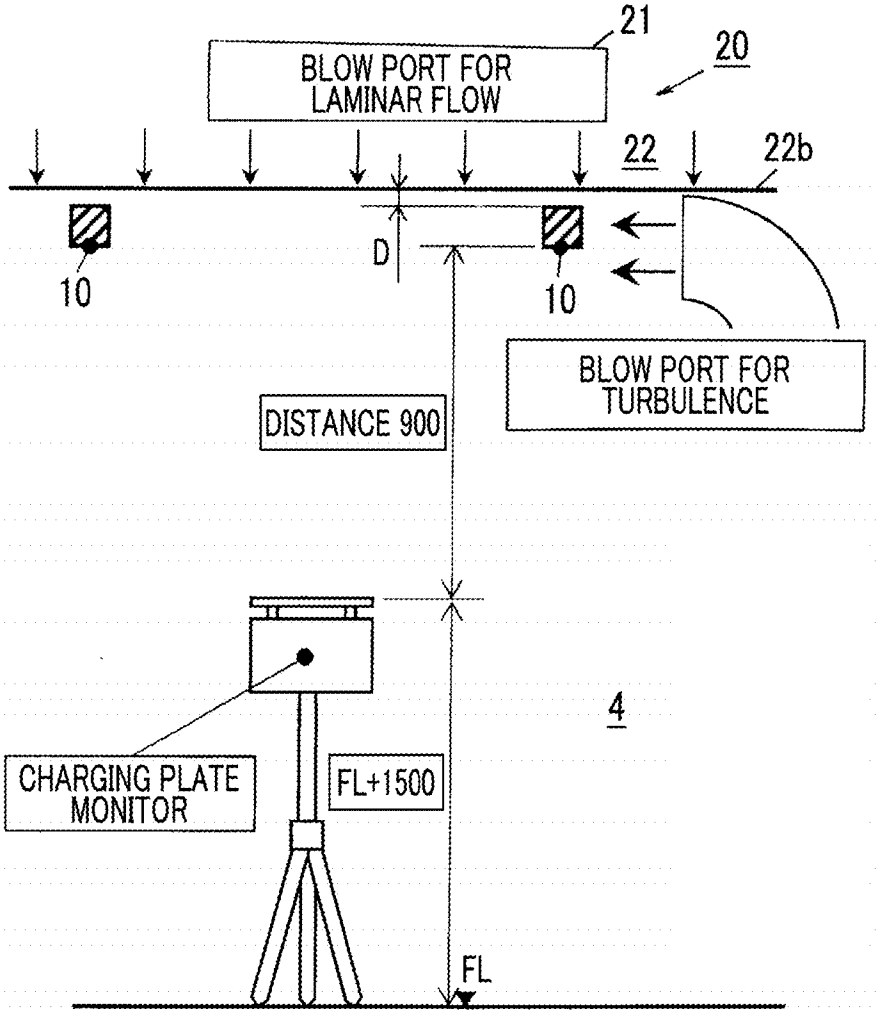
FIGS. 2A and 2B illustrate an example of the dry booth to which the static electricity removal structure in the low-humidity space according to the embodiment of the invention has been applied.
Figure 2A:
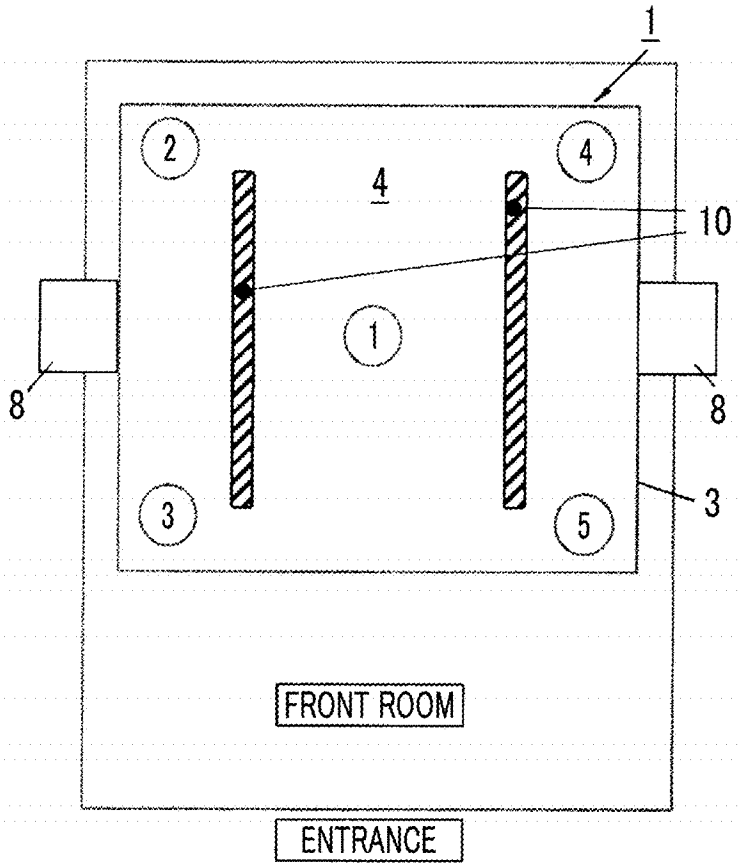

Next, FIGS. 2A and 2B illustrates an example of the static electricity removal structure in the low-humidity space according to the embodiment of the invention, which uses the dry booth 1.

In FIGS. 2A and 2B, a comparison test of a case (Example (described as "laminar flow")) where dehumidified air is supplied from the chamber 20 to the booth space (low-humidity space) 4 through the blowout surface material 22*b* in which the ventilation pore is formed and a case (Comparative Example (described as "turbulence")) being a method which is widely used in a dry booth, in which dehumidified air is supplied to the booth space (low-humidity space) 4 at a pinpoint, for example, in a horizontal direction.

A general-purpose static electricity removal device can be used as the static electricity removal device 10. However, in this example, two static electricity removal devices 10 are arranged as a pair and the static electricity removal devices are controlled as follows. One static electricity removal device 10 alternately generates positive ions and negative ions at a timing different from a timing when the other static electricity removal device 10 alternately generates positive ions and negative ions. Specifically, when one static electricity removal device 10 generates positive ions, the other generates negative ions. When one generates negative ions, the other generates positive ions.

Here, the static electricity removal device 10 used in this example has a rod shape. Thus, a static electricity removal device having a length which is 40% or greater of the length of one side of the substantially square booth space 4, and preferably 50% or greater (in this example, about 70%) can be used. The two static electricity removal devices 10 can be arranged on the downstream side of the blowout surface material 22*b* to be at a distance which is substantially equal to the length thereof, in parallel. Thus, an air ionized by the static electricity removal device 10 can be supplied to be dispersed in the entirety of the booth space 4.

The static electricity removal device 10 is disposed to be spaced from the blowout surface material 22*b* at a distance D (about 30 mm to 200 mm. In this example, about 50 mm). Thus, the occurrence of a situation in which positive ions and negative ions included in an air ionized by the static electricity removal device 10 collide with the blowout surface material 22*b* and thus ions are eliminated and the effect of removing static electricity is not obtained is prevented.

Figure 3:
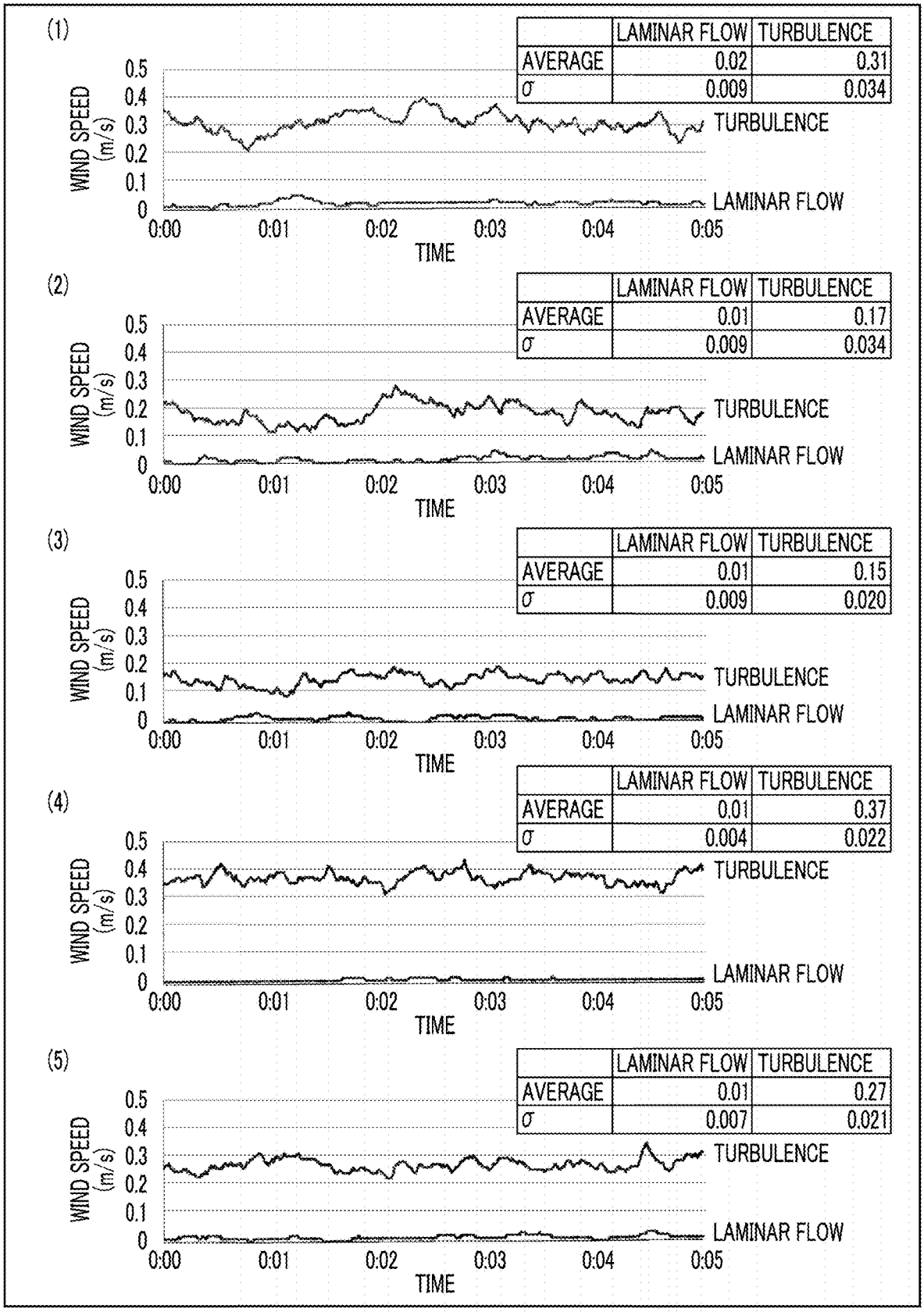
FIG. 3 is a graph illustrating results of measuring a change of a wind speed.

FIG. 3 illustrates results obtained by measuring a change of a wind speed in Example and Comparative Example for five minutes.

Here, the wind speed is measured at positions (place in which a charging plate monitor illustrated in FIG. 2B is installed) indicated by 1 to 5 which are circle numbers in FIG. 2A.

In Example, the wind speed and diffusion indicate values lower than those in Comparative Example. It is considered that it is possible to prevent the occurrence of a situation in which ions are eliminated by positive ions and negative ions colliding with each other, and thus the effect of removing static electricity is not obtained, and it is possible to prevent generation of static electricity by an air flow.

As the dehumidified air supplied to the booth space 4, an air having low humidity, that is, a dew point temperature of 0° C. or lower, particularly, an air having ultra-low humidity, that is, a dew point temperature of −30° C. or lower (in Example, −60° C.) is used. Static electricity is removed in a low-humidity space (ultra-low humidity space) formed by supplying the air having low humidity (air having ultra-low humidity), as a target.

The lower limit value of the dew point temperature of the low-humidity space as a target of the static electricity removal structure in the low-humidity space according to the embodiment of the invention is, for example, lower than −100° C. The load of the dehumidification unit 6 is not large, but the dew point temperature is not particularly limited.

Figure 4:
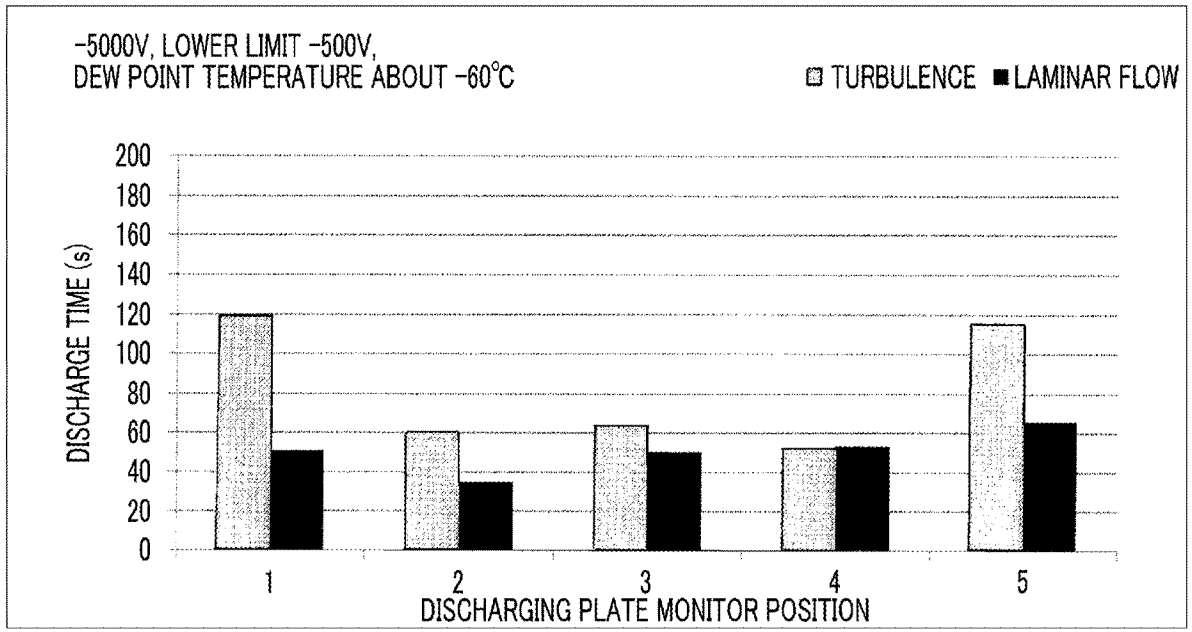
FIG. 4 is graph illustrating results of measuring a discharge time.

FIG. 4 illustrates results obtained by measuring a time (discharge time) taken until a charged voltage of a charging plate charged to −5000 V reaches −500 V, by using a charging plate monitor.

As clear from the results, in Example, it is confirmed that the discharge time shows a value lower than that in Comparative Example, and static electricity is removed in the entirety of the booth space 4.

From the measurement results, it is confirmed that, in a case where the dehumidified air is supplied in the laminar flow state, to the booth space 4, it is effective that the wind speed is set to be about 0.005 to 0.1 m/s, preferably about 0.008 to 0.05 m/s, more preferably about 0.01 to 0.02 m/s.

As described above, according to the static electricity removal structure in the low-humidity space according to the embodiment of the invention, even in a low-humidity space in which the moisture content in an air is very small, in particular, in an ultra-low humidity space in which the dew point temperature is −30° C. or lower (in Example, −60° C.), it is possible to supply the ionized air so as to be dispersed in the entirety of the low-humidity space and to remove static electricity with high efficiency by using the static electricity removal device, while generation of static electricity by an air flow and elimination of ions by collision between positive ions and negative ions are prevented.

Hereinafter, the static electricity removal structure in the low-humidity space according to the embodiment of the invention is described based on the example. However, the embodiment of the invention is not limited to the configuration described in the example. The configuration can be appropriately changed in a range without departing from the gist, for example, a direction of supplying the dehumidified air into the low-humidity space is set to be a transverse direction or upward direction other than a downward direction in Example.

The static electricity removal structure in the low-humidity space according to the embodiment of the invention can remove static electricity with high efficiency by using the static electricity removal device in the low-humidity space. Thus, the static electricity removal structure can be suitably used for removing static electricity in, for example, a space in which only the atmosphere of a limited necessary place in which various works such as assembling of electronic components, manufacturing of a secondary battery (including components), and examinations thereof are performed is held to be in a predetermined low-humidity state, more specifically, the booth space.

It should be understood that the invention is not limited to the above-described embodiment, but may be modified into various forms on the basis of the spirit of the invention. Additionally, the modifications are included in the scope of the invention.

What is claimed is:

1. A static electricity removal structure comprising:

a static electricity removal device configured to:

be present in a booth space when a laminar flow of air is about 0.005 to 0.1 m/s, and remove static electricity from the air that is in the booth space, wherein the static electricity removal device is sited in the booth space in a manner that permits a flow of the air in the booth space to flow, as the laminar flow of the air, across the static electricity removal device.

2. The static electricity removal structure according to claim 1, wherein the static electricity removal device is configured to be present in the booth space when the laminar flow of the air is about 0.008 to 0.05 m/s.

3. The static electricity removal structure according to claim 1, wherein the static electricity removal device is configured to be present in the booth space when the laminar flow of the air is about 0.01 to 0.02 m/s.

4. The static electricity removal structure according to claim 1, wherein the static electricity removal device is configured to be present in the booth space when a dew point temperature in the booth space is 0° C. or lower.

5. The static electricity removal structure according to claim 1, wherein the static electricity removal device is configured to be present in the booth space when a dew point temperature in the booth space is −30° C. or lower.

6. The static electricity removal structure according to claim 1, wherein the static electricity removal device is configured to be present in the booth space when a dew point temperature in the booth space is −60° C.

7. The static electricity removal structure according to claim 1, further comprising:

an additional static electricity removal device configured to remove the static electricity from the air that is in the booth space.

8. The static electricity removal structure according to claim 7, wherein the additional static electricity removal device is sited in the booth space in a manner that permits the flow of the air in the booth space to flow, as the laminar flow of the air, across the static electricity removal device and the additional static electricity removal device.

9. The static electricity removal structure according to claim 7, wherein the static electricity removal device is in parallel with the additional static electricity removal device.

10. The static electricity removal structure according to claim 7, wherein the static electricity removal device is configured to generate positive ions when the additional static electricity removal device generates negative ions, the additional static electricity removal device is configured to generate positive ions when the static electricity removal device generates negative ions.

11. The static electricity removal structure according to claim 1, wherein a blow port is configured to supply the air into the booth space.

12. The static electricity removal structure according to claim 11, wherein a blow port is configured to supply the air into the booth space at a dew point temperature of −30° C. or lower.

13. The static electricity removal structure according to claim 11, wherein the static electricity removal device is sited in the booth space downstream from the blow port.

14. The static electricity removal structure according to claim 11, wherein a space is between the static electricity removal device and the blow port.

15. The static electricity removal structure according to claim 11, wherein the blow port is at one side of the booth space and the air is exhaustible from the booth space at another side of the booth space.

16. The static electricity removal structure according to claim 11, wherein a blowout surface material in which a ventilation pore is formed is provided in the blow port.

17. The static electricity removal structure according to claim 16, wherein the blowout surface material in which the ventilation pore is formed is formed of a synthetic resin member.

18. The static electricity removal structure according to claim 1, wherein the static electricity removal device is an ionizer.

19. The static electricity removal structure according to claim 1, wherein the air is dehumidified air.

20. The static electricity removal structure according to claim 1, wherein the booth space is covered with a double structure curtain, exhausting is forcibly performed from a space formed by the double structure curtain.

21. The static electricity removal structure according to claim 9, wherein a blow port is configured to supply the air into the booth space, and the static electricity removal device and the additional static electricity removal device are sited in the booth space downstream from the blow port in parallel with each other and spaced from the blow port at equal distances.

* * * * *